United States Patent [19]

Yasufuku

[11] Patent Number: 4,477,193

[45] Date of Patent: Oct. 16, 1984

[54] TERRESTRIAL GLOBE INCLUDING A WORLD CLOCK

[75] Inventor: Shouji Yasufuku, Gifu, Japan

[73] Assignee: Unionelecs Kabushiki Kaisha, Gifu, Japan

[21] Appl. No.: 447,527

[22] Filed: Dec. 7, 1982

[30] Foreign Application Priority Data

Feb. 23, 1982 [JP] Japan ..... 57-27895

[51] Int. Cl.[3] ..... G04B 19/22

[52] U.S. Cl. ..... 368/24; 368/23

[58] Field of Search ..... 368/21-24

[56] References Cited

U.S. PATENT DOCUMENTS

| | | | |
|---|---|---|---|
| 3,822,545 | 7/1974 | Catto et al. | 368/22 |
| 3,940,920 | 3/1976 | Nakamura et al. | 58/42.5 |
| 3,983,688 | 10/1976 | Kockinos | 58/44 |

*Primary Examiner*—Bernard Roskoski

*Attorney, Agent, or Firm*—Robert E. Burns; Emmanuel J. Lobato; Bruce L. Adams

[57] ABSTRACT

The present invention relates to a terrestrial globe comprising a world map carrying spherical body rotatably supported around the Antarctic and Arctic points on a stand, and luminous bodies such as light emitting diodes mounted on selected points corresponding to major cities or like in the world map so that a group of the luminous bodies mounted on the points of same standard time are lit when these luminous bodies come into a plane defined by the front side of the stand, and particularly to a terrestrial globe in which the standard time of the zone defined by a group of the luminous bodies is displayed by a digital clock mounted on the stand. The present invention further relates to a terrestrial globe in which the luminous bodies mounted on the spherical body are electrically connected via a circular arc-shaped support arm for said spherical body to a source circuit arranged within the stand.

5 Claims, 3 Drawing Figures

TERRESTRIAL GLOBE INCLUDING A WORLD CLOCK

BACKGROUND OF THE INVENTION

The present invention relates to a terrestrial globe comprising a world map in the form of a spherical body rotatably supported around the Antarctic and Arctic points on a stand, and luminous bodies such as light emitting diodes mounted on selected points corresponding to major cities or the like on the world map so that a group of the luminous bodies mounted on the points of the same standard time are lit when these luminous bodies come into a plane defined by the front side of the stand, and particularly to a terrestrial globe in which the standard time of the zone defined by a group of the luminous bodies is displayed by a digital clock mounted on the stand. The present invention further relates to a terrestrial globe in which the luminous bodies mounted on the spherical body are electrically connected via a circular arc-shaped support arm for the spherical body to a source circuit arranged within the stand.

An object of the present invention is to provide a terrestrial globe comprising a world map in the form of a spherical body rotatably supported around the Antarctic and Arctic points on a stand, the luminous bodies mounted on selected points corresponding to major cities on the world map so that a group of the luminous bodies mounted on the points of the same standard time are lit when these luminous bodies come into the plane defined by the front side of the stand and a digital clock mounted on the stand so as to display the standard time of the zone defined by a group of the luminous bodies, and to such a terrestrial globe having high accuracy with which said digital clock may be controlled.

Another object of the present invention is to provide such a terrestrial globe having easy connection of the respective luminous bodies with the source circuit.

SUMMARY OF THE INVENTION

The present invention comprises a terrestrial globe having a spherical body carrying a world map; a stand on which said spherical body is rotatably supported around the Antarctic and Arctic points; luminous bodies such as light emitting diodes mounted on selected points corresponding to major cities or the like on said world map; and a rotary switch adapted to be driven as said spherical body is rotated. The luminous bodies which are mounted on the points of the same standard time are connected to respective stationary contacts of said rotary switch; and a movable contact of said rotary switch is connected to a source circuit. Respective ones of the stationary contacts and the movable contact of said rotary switch, or another rotary switch operatively associated with the first-mentioned rotary switch, is connected to a clock control circuit arranged within said stand. A digital clock is mounted on said stand; and said clock control circuit is connected to said digital clock; wherein the particular stationary contacts with which the movable contact of said first-mentioned rotary switch or said another rotary switch is in contact is detected by said clock control circuit and a time to be displayed by said digital clock depends on the detection signal. Such arrangement that the particular stationary contacts with which the movable contact of the rotary switch is in contact is detected and thereby the time to be displayed by the digital clock is determined permits the standard time of the points in question to be correctly displayed without any influence of noises and regardless of the direction in which the terrestrial globe is rotated. The present invention also comprises a terrestrial globe comprising a spherical body carrying a world map; a stand; an electrically conductive and circular arc-shaped support arm erected on said stand for rotatably supporting said spherical body around the Antarctic and Arctic points; luminous bodies such as light emitting diodes mounted on selected points corresponding to major cities or the like on said world map; a rotary switch arranged within said spherical body and having a movable contact fixedly mounted on one support shaft of said spherical body and stationary contacts fixedly mounted on said spherical body itself; said luminous bodies mounted on the points of the same standard time being connected to respective stationary contacts of said rotary switch; and said stationary contacts or said movable contact of said rotary switch being connected via said support arm to a source circuit arranged within said stand while the other being connected via a conductive member insulated with respect to said support arm to said source circuit. Such arrangement that the support arm adapted to support the spherical body on the stand is realized as a conductive member via which the rotary switch is connected to the source circuit arranged within the stand makes the electrical connection substantially easier.

It should be understood that the present invention may apply to a terrestrial globe adapted to display the points of the same standard time by flashing of the luminous bodies without display of the standard time.

BRIEF DESCRIPTION OF THE DRAWING

A preferred embodiment of the present invention is shown by the accompanying drawing in which.

DESCRIPTION OF THE PREFERRED EMBODIMENT

Figure 1:
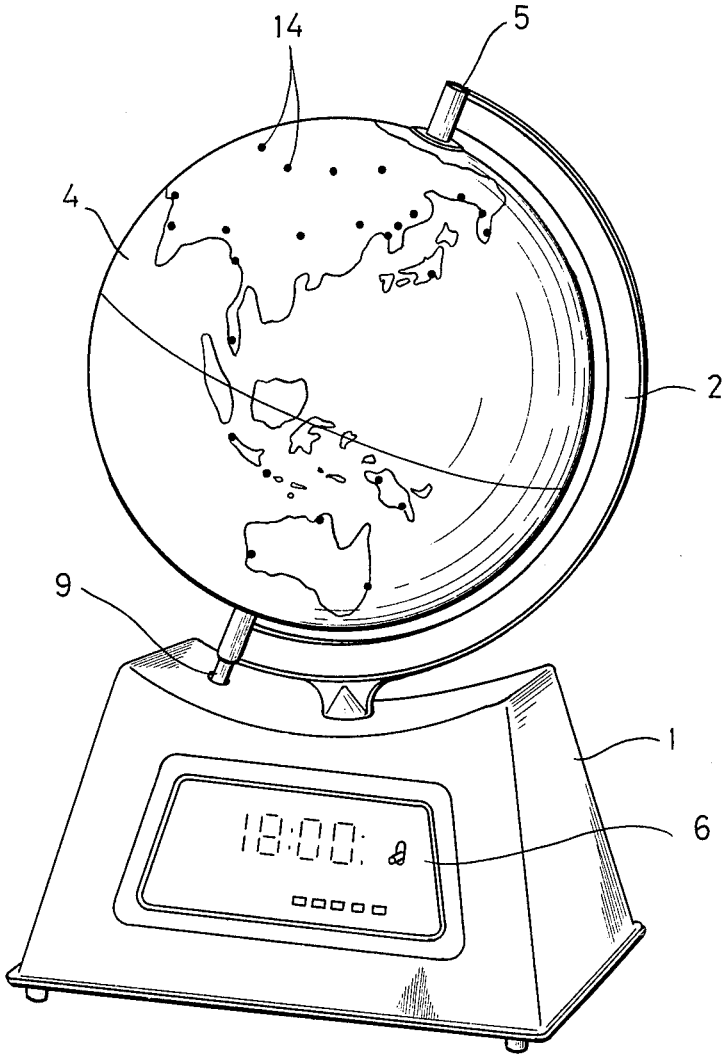
FIG. 1 is a perspective view.
Figure 2:
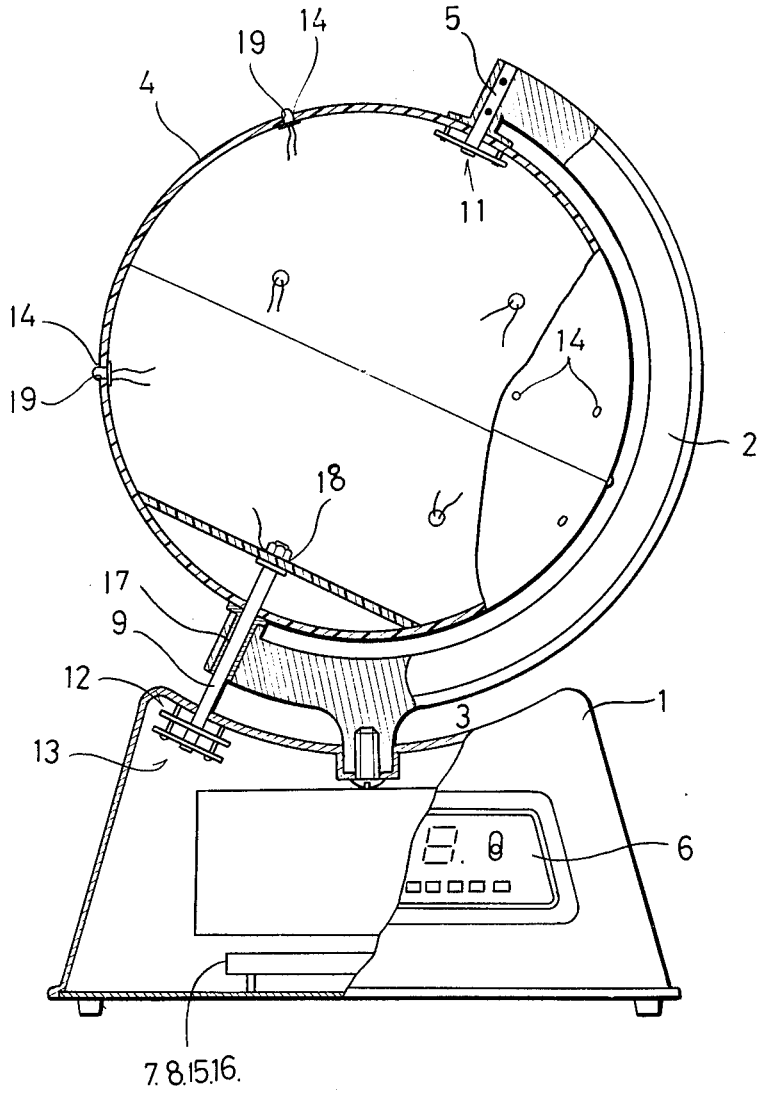
FIG. 2 is a front view as partially broken away.

A preferred embodiment of the present invention will be described with reference with the accompanying drawing.

A circular arc-shaped metallic support arm 2 is secured by a screw 3 on the upper side of a stand 1 having a digital clock 6 mounted on the front side. A spherical body 4 representing a world map on its spherical surface and consisting of upper and lower halves which respectively correspond to the northern and southern hemispheres and joined together along the equator is rotatably supported by a stationary metallic shaft 5 which is, in turn, fixed to the upper end of the support arm 2, on one side, and by a rotatable metallic shaft 9 which is rotatably supported by the lower end of the support arm 2 with interposition of an insulator 17, on the other side. The rotable shaft 9 is fastened by a nut 18 threaded therearound at the upper end of the rotatable shaft 9 with respect to the spherical body 4 while the lower end of the rotatable shaft 9 projects into the stand 1 and is fixedly provided on its tip with movable contacts D of a second rotary switch 12 and third rotary switch 13, respectively. The movable contact D of a first rotary switch 11 is fixed to the tip of the stationary shaft 5 within the spherical body 4. A stationary contact S of the first rotary switch 11 is fixedly mounted within the spherical body 4 while stationary contacts S of the second and third rotary switches are fixedly mounted within the stand 1. A plurality of illuminatable elements such as light emitting diodes 14 are stationarily mounted in associated mounting holes 19 arranged at positions corresponding to the major cities of the world on the spherical body 4. The stand 1 contains therein a clock control circuit 7, a transformer 15 adapted to drop the voltage of a commercial AC voltage source AC, and a source circuit 8 and a flashing circuit 16 both connected to said transformer 15.

Figure 3:
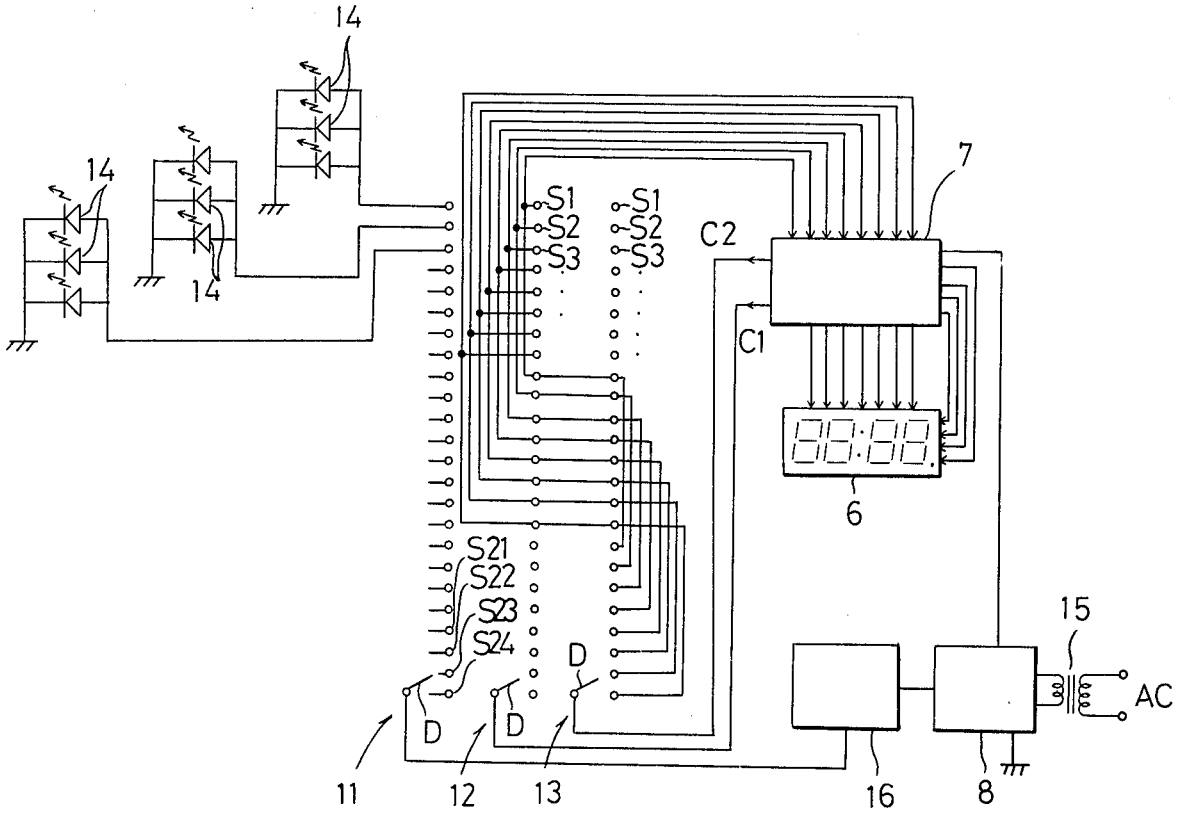
FIG. 3 is a block diagram illustrating the electric circuitry arrangement incorporated therein.

Now the electric circuit arrangement in this embodiment will be described with reference to FIG. 3. The first, second and third rotary switches 11, 12, 13 respectively have sets of twenty-four stationary or peripheral contacts S1, S2, S3, . . . S22, S23, S24. (These stationary or peripheral contacts are distributed at equal angular distances around the rotation axes 5, 9 of the associated movable center contacts D but are shown as being linearly arranged for convenience of drawing. Each group of the light emitting diodes 14 which are mounted on points of the same standard time (based on the Greenwich mean time system) are connected to the respective stationary contacts of the first rotary switch 11 and the movable contact D of this first rotary switch 11 is electrically connected to the stationary shaft 5 and the support arm 2, and connected by a lead fixed to the screw 3 to the flashing circuit 16 which is, in turn, connected to the source circuit 8. The light emitting diodes 14 have terminals of the other side connected to a lead fixed by the nut 18 around the rotatable shaft 9, on one side, and connected by this rotatable shaft 9 to the source circuit 8, on the other side.

The stationary contacts of the second and third rotary switches 12, 13 are respectively divided into three groups S1~S8, S9~S16 and S17~S24. Two groups of the stationary contacts S1~S8 and S9~S16 of the second rotary switch 12 are connected to the clock control circuit 7, two groups of the stationary contacts S9~S16 and S17~S24 of the third rotary switch 13 are connected to the clock control circuit 7, and the movable center contacts D of the second and third rotary switches are respectively connected to first and second pulse generating terminals C1, C2 of the clock control circuit 7. The digital clock 6 is provided with a 7-segmental display of four positions adapted to display the hour and minute in accordance with signals generated by the clock control circuit 7.

The manner in which the present embodiment functions will now be described. When the spherical body 4 is rotated to bring a standard point, e.g., Tokyo to a reference point on the stand, for example, the front side of the stand, and the movable contact D is brought into contact with the first stationary contact S1 of the first rotary switch 11 to which is connected the group of the light emitting diodes 14 mounted on the points of same standard time inclusive of Tokyo, this group of the light emitting diodes 14 is connected by the flashing circuit 16 to the source circuit 8 and, in consequence, begin to flash. In such a state, the time displayed by the digital clock 6 is adjusted to the local standard time of the standard time zone including Tokyo. On this time point, the movable contacts D of the second and third rotary switches 12, 13 also bear against the respective first stationary contacts S1. If the spherical body 4 is rotated again to bring, for example, the movable contacts D of the respective rotary switches 11, 12, 13 into contact with the respective third stationary contacts S3, the group of the light emitting diodes 14 connected to the third stationary contact S3 of the first rotary switch 11 will then begin to flash. The clock control circuit 7 detects that the movable contacts D of the second and third rotary switches 12, 13 are in contact with the respective third stationary contacts S3 and applies the digital clock 6 with signals instructing the digital clock 6 to set the presently displayed time ahead by 2 hours. The displayed time is thus changed. In such manner, the clock control circuit 7 detects the particular stationary contacts S with which the respective movable contacts D of the second and third rotary switches 12, 13 are in contact and, upon this detection, applies the digital clock 6 with corresponding signals instructing the latter to put the presently displayed time as on a standard point ahead by a given hours. This embodiment is so arranged that clock pulses generated by the first and second pulse generating terminals C1, C2 of the clock control circuit 7 may be applied to the respective movable contacts D of the second and third rotary switches 12, 13. Only the clock pulses generated by the first pulse generating terminal C1, are applied to the clock control circuit 7 when the respective movable contacts D are in contact with any ones of the associated stationary contacts S1~S8, the clock pulses generated by both the first and second pulse generating terminals C1, C2 are applied to said clock control circuit 7 when the respective movable contacts D are in contact with any ones of the associated stationary contacts S17~S24. It is possible, therefore, to discriminate the particular group of the stationary contacts S1~S8, S9~S16 or S17~S24 with which the respective movable contacts D of the second and third rotary switches 12, 13 are in contact in accordance with said input signals. Such feature advantageously permits arrangement of the clock control circuit 7 to be simplified, i.e., to have its input terminals substantially reduced. If no regard is paid to such advantage, the second and third rotary switches 12, 13 might be utilized or the first rotary switch 11 might be utilized also as these second and third rotary switches 12, 13 so that the twenty-four stationary contacts might be connected to the twenty-four input terminals of the clock control circuit 7.

What is claimed is:

1. A terrestrial globe comprising: a generally spherical body having on its outer surface a representation of a world map; a stand having means mounting the spherical body for manual rotational displacement about an axis of rotation relative to the stand; a plurality of energizeable illuminatable elements having illuminated and non-illuminated states and being disposed on the spherical body outer surface at points corresponding to preselected geographical regions on the world map which are located in the standard time zones of the world based on Greenwich mean time, the illuminatable elements within each standard time zone being connected together in a common group and the respective groups being angularly spaced apart around the spherical body; electric circuit means connected to the groups of illuminatable elements for energizing whichever illuminatable element group is disposed in a predetermined angular position relative to a reference point on the stand; and timekeeping means for keeping time and for displaying the local standard time corresponding to that of the standard time zone associated with the energized illuminatable element group.

2. A terrestrial globe according to claim 1; wherein the timekeeping means includes means responsive to rotational displacement of the spherical body to adjust the displayed time to correspond to that of the local standard time zone associated with whatever illuminatable element group is disposed in the predetermined angular position relative to the reference point on the stand.

3. A terrestrial globe according to claim 2; wherein the electric circuit means includes a rotary switch having a plurality of angularly spaced-apart fixed contacts each connected to respective ones of the illuminatable element groups, and a movable contact connected to undergo rotational displacement in conjunction with the rotational displacement of the spherical body and being operative to electrically contact the fixed contact connected to the illuminatable element group which is disposed in the predetermined angular position relative to the reference point on the stand.

4. A terrestrial globe according to claim 1; wherein the electric circuit means includes a rotary switch having a plurality of angularly spaced-apart fixed contacts each connected to respective ones of the illuminatable element groups, and a movable contact connected to undergo rotational displacement in conjunction with the rotational displacement of the spherical body and being operative to electrically contact the fixed contact connected to the illuminatable element group which is disposed in the predetermined angular position relative to the reference point on the stand.

5. A terrestrial globe including a world clock, comprising: a hollow spherical body having on its outer surface a representation of a world map; a stand; an electrically conductive, circular arc-shaped support arm supported on said stand; a first support shaft electrically connected to said support arm at a point corresponding to the Arctic point of said spherical body; a second support shaft electrically insulated from said support arm at a point corresponding to the Antarctic point of said spherical body; said spherical body being rotatably supported by said first and second support shafts; a rotary switch including a plurality of peripheral contacts arranged around a movable central contact, the central contact being engageable with a selected one of said peripheral contacts in response to relative rotation of said peripheral contacts and said central contact; said rotary switch being mounted on the inner surface of said spherical body at a position corresponding to one of said Arctic point and said Antarctic point with the peripheral contacts being fixed to said spherical body and the central contact being fixed to one end of said support arm associated with said first or second support shaft in electrical connection therewith; light emitting diodes mounted on the outer surface of said spherical body at a plurality of selected points corresponding to major cities or the like on said world map; each group of said light emitting diodes associated with each zone having the same standard time being connected at their respective one terminals with the respective peripheral contacts of said rotary switch and at their other terminals with said other support shaft; a source circuit incorporated in said stand and to which said second support shaft and said support arm are connected; a digital clock mounted on said stand; and clock control circuit means through which said rotary switch or another rotary switch operatively associated therewith is connected for detecting which group of light emitting diodes is connected to the central contact and providing a detection signal serving to determine a standard time to be displayed by said digital clock corresponding to the standard time zone associated with the selected group of light emitting diodes.

* * * * *